US005503314A

United States Patent [19]

Fiscus

[11] Patent Number: 5,503,314

[45] Date of Patent: Apr. 2, 1996

[54] HELIXICAL BACKPACK CARRIER

[76] Inventor: Wayne R. Fiscus, P.O. Box 27182, Phoenix, Ariz. 85061

[21] Appl. No.: 263,511

[22] Filed: Jun. 21, 1994

[51] Int. Cl.[6] ..... A45F 3/00; A45F 3/10; A45F 3/08

[52] U.S. Cl. ..... 224/224; 224/211; 224/262

[58] Field of Search ..... 224/210, 211, 224/215, 262, 261, 213, 212, 263, 224

[56] References Cited

U.S. PATENT DOCUMENTS 4,369,903 1/1983 Wilkes ..... 224/212
4,976,383 12/1990 Norris ..... 224/215

FOREIGN PATENT DOCUMENTS 467711 4/1914 France ..... 224/209
1917 of 1896 United Kingdom ..... 224/211
WO93/14669 8/1993 WIPO ..... 224/211

*Primary Examiner*—Linda J. Sholl
*Attorney, Agent, or Firm*—Harry M. Weiss; Jeffrey D. Moy; Harry M. Weiss and Associates

[57] ABSTRACT

A backpack carrier device for directing the weight of the burden carried toward the center of gravity of the wearer, which will permit carrying heavier than normal burdens much more comfortably with less energy expended. The design of this carrier is helixical with inherent shock absorption and flexibility, plus an adjustable shock absorbing mechanism. It also permits greater maneuverability of the wearer and eliminates compression forces on the shoulders since there are no shoulder straps. The carrier is adjustable to fit differing torso sizes and can be disassembled into component parts. It will permit the carrying of a variety of backpacks according to the needs of the wearer, eg. day pack, child carrier, military pack, fireman's pack, etc.

11 Claims, 3 Drawing Sheets

HELIXICAL BACKPACK CARRIER

BACKGROUND OF THE INVENTION

1. Field of the Invention

The present invention relates to backpack carriers, and more particularily, to backpack carriers that have an helixical configuration that brings the center of gravity (COG) of the burden carried in closer approximation to the wearer's own COG and that have an attaching means for a variety of packs, and which permits carrying heavier than normal burdens much more comfortably with less energy expended by the wearer and with greater maneuverability.

2. Description of Prior Art

The problem that many people have with carrying a backpack is that a heavy load in the backpack tends to severly compress the shoulders of the user. This compressive force causes several adverse affects. Among these adverse affects are: restriction in the movement of the neck and the shoulders of the backpack wearer, intense pain in the shoulder muscle, and even severe restriction in the ability to breath. These problems exist even if an individual uses the most advanced backpacking equipment.

Simply put, there is still one major disadvantage with existing technologies; whether with of without shoulder straps, internal or external frames, or comprising devices for shifting much of the weight of the burden to the hips: the center of gravity of the burden lies far behind that of the COG of the wearer, which passes down through the vertebral body of the fourth lumbar and just anterior to the base of the sacrum. The more distant the COG of the burden is from the wearer's COG, the greater the Load Arm (distance) and thus the greater the Moments of Force (weight X distance= moments of force) generated. The greater the Moments of Force the greater the energy expended and discomfort to the wearer.

Backpacks that rest the burden on the shoulders by means of straps keep the COG of the burden closer to that of the wearer but restrict to some degree the movement of the neck, shoulders, ribs, and diaphram; more so as the weight increases. Those that shift the weight to the hips have done so at the expense of increasing the Load Arm of the burden from the wearer's COG. As the burden's COG moves posteriorly away from the wearer's COG, the same amount of weight will generate greater Moments of Force. These forces will then be vectored posteriorly and inferiorly creating a levering effect which will either apply more force to the shoulder straps, or if no shoulder straps and with a heavy enough burden, the waist belt will likely slip downward over the buttocks and fall to the ground.

The following U.S. Pat. Nos. 5,184,764, 4,676,418, 4,561,578, 4,479,595, 4,420,103, 4,303,186, and 4,013,201 demonstrate various improvements in backpack frames and carriers which utilize shoulder straps attached to rigid or flexible, internal or external frames. Some of these designs have afforded increased movement of the shoulders and/or hips, provided load-balancing mechanisms, tried to distribute some of the weight to the hips, and offered load-adjusting mechanisms to reduce fatigue. However much these devices may be an improvement over earlier models, they still allow a large portion of the weight to be borne by the shoulders. The present invention does not have weight-bearing shoulder straps and thus eliminates this problem.

With U.S. Pat. Nos. 5,160,073, 5,090,604, 4,369,903, 4,307,826, 4,189,076, 4,015,759, 3,923,216, and 3,516,596 attempts are made at shifting a larger portion of the weight to the hips and/or attempting to provide greater maneuverability. But here again whether they have rigid or flexible frames, with or without shoulder straps, the COG of the burden is not aligned with that of the wearer and in fact is sometimes made worse. Thus reducing the amount of burden that may comfortably be borne, increasing the energy expenditure, as well as reducing maneuverability.

What is needed is a mechanism that will vector the forces of gravity forward toward the sacral base, not backward toward the sacral apex. The present invention vectors the forces of the burden toward the sacral base to more closely align with the wearer's COG and thus substantially minimizing the possibility of the above related problems occuring.

SUMMARY OF THE INVENTION

It is the primary object of the present invention to provide a backpack carrier that will allow the weight of the burden being carried to be more closely aligned with the center of gravity (COG) of the wearer's body and thus directing the forces of such weight through the pelvis to the legs.

It is another object of the present invention to provide a backpack carrier with an upper body attachment that will allow freedom of movement of the neck, shoulders, arms, ribs and diaphram.

It is another object of the present invention to provide a backpack carrier with both an inherent and an adjustable shock absorbing mechanism.

It is an additional object of the present invention to provide a backpack carrier that is adjustable to fit differing torso lengths.

It is a further object of the present invention to provide a backpack carrier with a means of attachment whereby a multitude of types of burdens may be supported by it.

It is a further object of the present invention to provide a backpack carrier comprising component parts that can be assembled easily or disassembled for storage or shipment.

It is a still further object of the present invention to provide a backpack carrier that affords a higher degree of maneuverability by the wearer.

It is a still further object of the present invention to provide a backpack carrier that allows a greater reduction of energy expenditure and fatigue by the wearer.

The foregoing objects can be accomplished by providing a carrier mechanism comprising the following features: An helixical main frame made of flexible material formed into a sinusoidal and undulating pattern with a vertical stabilizer component attached to the base portion and paralleling the anteroposterior curves of the thoracolumbar spine of the wearer; an upper body attachment that connects to the vertical stabilizer portion of the main frame which encircles the chest under the wearer's arms, with a coupling means in front, and with adjustable and rotatable members that move to accomodate chest expansion; a flexible pelvis-encircling belt component to which the main frame is coupled; and an adjustable shock absorbing mechanism component that attaches to the top of the main frame that has a coupling device to which various types of packs can be attached.

The device works much like a child being carried "piggy-back". The helixical main frame conforms to the body of the wearer and rests on the pelvis and the lumbar spine. Being flexible it absorbs some of the shock created by body movement. The upper body attachment being under the arms does not transfer weight to the shoulders and allows complete freedom of movement of the neck, shoulders, ribs and diaphram, and does not interfere with the physiological counter-rotation of the hips and shoulders. The pack itself is attached to the shock absorbing mechanism at the top of the main frame and can be adjusted according to the weight of the burden to further reduce the effects of the compressive forces. Having thus brought the center of gravity of the burden carried into closer approximation with the center of gravity of the bearer, greater maneuverability is attained and less energy is expended for the amount of weight carried.

The invention accordingly comprises the features of construction, combination of elements, and arrangement of parts which will be exemplified in the following detailed description and more particularly defined by the appended claims, it being understood that changes in the precise embodiment of the herein disclosed invention are meant to be included as come within the scope of the claims.

DETAILED DESCRIPTION

Figure 1:
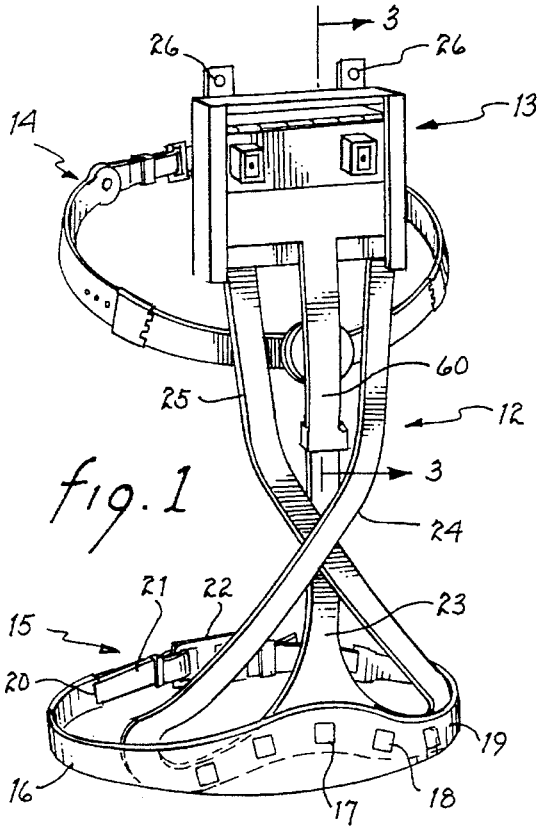
In FIG. 1 a posterior view is shown of a single phase double helix main frame embodiment of the present invention.
Figure 2:
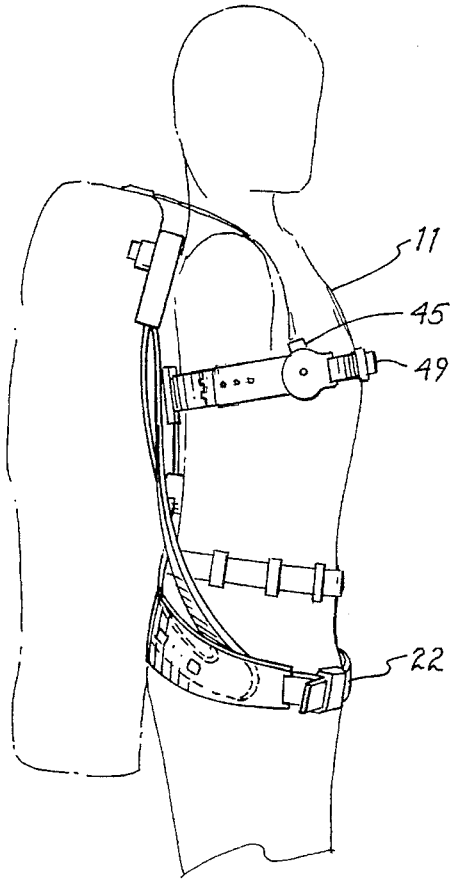
FIG. 2 is a lateral view of the present backpack carrier on the back of a wearer.

Refer now to FIGS. 1 & 2 showing user 11 wearing the preferred embodiment of the Helixical Backpack Carrier comprising the major components: 12-the helixical main frame; 13-the shock absorbing and pack attachment mechanism; 14-the upper body attachment mechanism, and; 15-the pelvis encircling belt.

Figure 5:
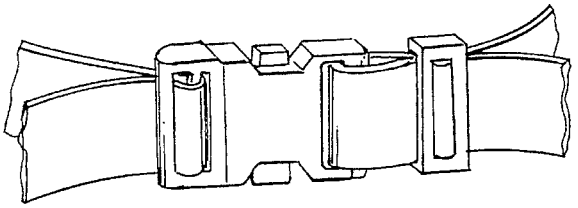
FIG. 5 is an elevation view showing a buckle coupling for the pelvis encircling belt and the upper body attachment.

The pelvis encircling belt 15 consists of a strong lightweight flexible material, such as plastic polymer, that is formed into a sheet 16 approximately 4"–5" wide in the middle and tapering to approximately 2" wide at both ends with the bottom edge straight. Near the middle of 16 are registered rectangular appertures 17 that will receive the rectangular protuberances 18 of the base 19 of the main frame 12. Near the ends of belt component 16 are vertical slots 20 through which belts 21, such as nylon, are attached. These belts then are coupled in the front of the pelvis by means of buckle 22 as shown in FIGS. 1,2,5. This belt will hold the base 19 of the main frame 12 over the sacrum and partially encircling the pelvis so that the forces exerted upon the main frame 12 will be directed toward the inside of the pelvis and closely approximating the body's own center of gravity (COG). The belt 16, the base 19 of the main frame 12, and the lower portion of the vertical stabilizer 23 may be encased in a material such as canvas, nylon, etc. with padding for greater comfort of the wearer.

Figure 4A:
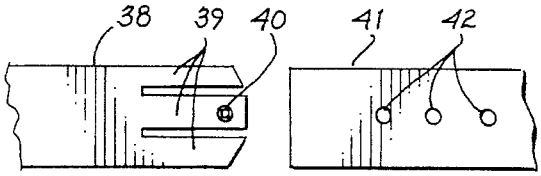
FIG. 4A is an elevation view of the telescoping arms of the upper body attachment mechanism.

The main frame component 12 is made of a strong lightweight but less flexible bar material, eg. plastic polymer, that has a base 19 that declines laterally from the middle and with an anterior inclination corresponding to that of the posterior aspect of the sacrum, and upon which it rests. From this midpoint of base 19 rises a vertical stabilizer portion 23 with undulating (anterior/posterior) curves corresponding to the thoracolumbar spinal curves. Laterally base 19 then curves anteriorly then superiorly and medially crossing each other forming helices 24 & 25, then becoming parallel on top. This main frame also undulates to conform to the anteroposterior curves of the torso. As the weight of the burden increases the base 19 and vertical stabilizer 23 rotate anteriorly, vectoring the forces even further toward the fourth lumbar vertebra and the wearer's COG. The top ends of the helixes 24 & 25 are perforated with centered, equally spaced circular holes 26 with which they connect to the shock absorbing and pack attachment mechanism 13 in the position that best fits the length of the wearer's torso. The top end of the vertical stabilizer 23 also is perforated with centered, equally spaced circular holes 27 (FIGS. 4,8) which connects to the upper body attachment mechanism 14 at connector 28 in the position that best fits the torso length of the wearer. This undulating helixical design permits contraction and extension similar to that of the body's muscle fibers. The amplitude of succeeding frequencies lessens also which provides greater stability on top. This mechanism also provides some inherent shock absorption of the forces of the burden carried according to the degree of flexibility of the material used. In addition, depending on the flexibility of material used; forward and backward bending of the main frame will be permitted.

Figure 4B:
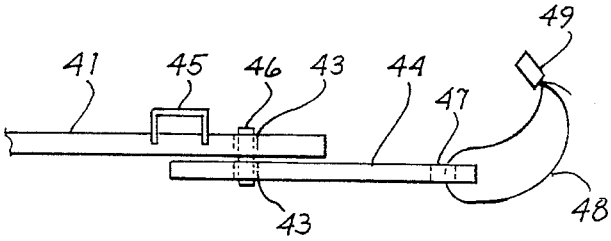
FIG. 4B is a top view of the connection of the distal arm segments of the upper body attachment mechanism.
Figure 4:
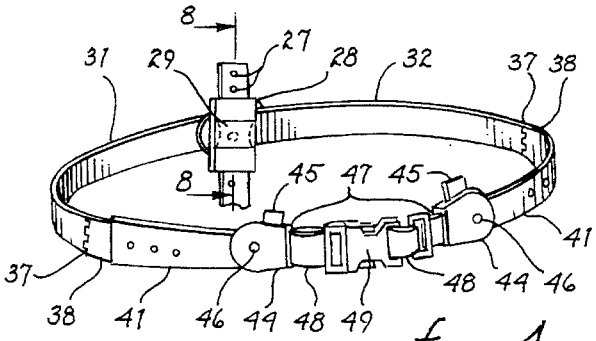
FIG. 4 is an anterior view of the upper body attachment that encircles the chest.
Figure 8:
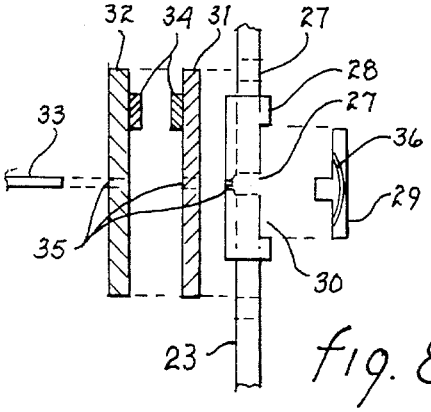
FIG. 8 is an enlarged view along line 8—8 of FIG. 4 showing the connection of the upper body attachment to the vertical stabilizer of the main frame.

The upper body attachment mechanism 14 (FIGS. 1,2,4) is made up of similar but semi-rigid material for the arms 31 & 32 that are rotatably attached to connector 28 by means of fastner 33, such as a rivet or screw. FIG. 8 shows how the connector 28 is held in the desired position on the vertical stabilizer 23 of main frame 12 by means of clip 29 inserted into opening 30 in connector 28 and hole 27 of vertical stabilizer 23. The ends of clip 29 have bevelled semi-circular indentations 36 on the inside surface with which to grasp the clip when extracting. The proximal ends of arms 31 & 32 are flat and circular and molded in such a way as to have opposite tangential, horizontal projections 34 on a portion of the periphery of each that will strike the opposite member when rotated and thus limit the upward movement of both arms. In the center of the circular ends of 31 & 32 and the back of connector 28 are registered holes 35 through which fastner 33 is inserted to connect both arms to connector 28. Arms 31 & 32 are curved at a constant ratio to encircle the upper body and are hinged at 37 to similar arms 38 that are also curved in the same manner inward to conform to the chest and are made so that they slide inside the tubular sections 41. This telescoping of the arms will allow for variations in chest size. The distal ends of arms 38 will be split into three prongs 39 as in FIG. 4A with the middle prong having a spherical protuberance 40 extending outward. The proximal end of arm section 41 will have several holes 42 equally spaced and centered on the outward surface. When the pronged end of arms 38 are inserted into the tubular ends of 41 the spherical protuberance 40 will fit snugly into the holes 42; thus locking the telescoping portions into a fixed position to accomodate the size of the wearer's chest. The distal ends of arms 41 will be flat and circular with registered holes 43 at the center which will articulate by means of fastner 46 in a rotary fashion with arm sections 44 whose proximal ends will also be flat and circular with centered holes 43 (FIG. 4B). Near the distal end of arm segment 41 and on top is located a rectangular tangential projection 45. This will be used for attaching a stabilizing strap from the top of an attached pack (FIG. 2). Near the distal ends of arm sections 44 are vertical slots 47 through which belts 48 are attached as shown in FIG. 4B. Belts 48 are then coupled by means of buckle 49 as shown in FIG. 5 but will be of smaller size than buckle 22. When utilized as described above the upper body attachment mechanism 14 will hold the top of the main frame against the wearer's upper torso. It will encircle the wearer under the arms from the mid to lower thorax in the back to just below the sternum in the front. The encircling arms will thus be able to rotate upward and downward to allow for the expansion and contraction of the chest with unrestricted diaphramatic movement when breathing. This position will also allow complete freedom of movement of the arms, shoulders, and neck while relieving the wearer of any compressive forces on the shoulders. In an alternative embodiment the upper body attachment mechanism can also be attached directly to the helixical main frame component.

Figure 3:
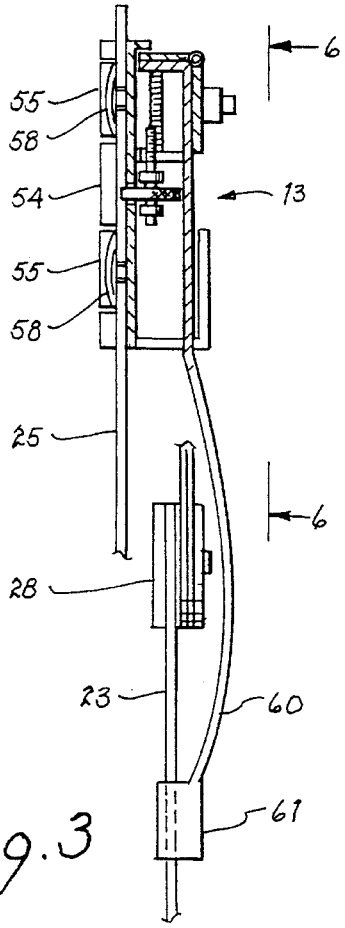
FIG. 3 is a lateral view along line 3—3 of FIG. 1 showing the shock absorbing mechanism for packs.
Figure 3A:
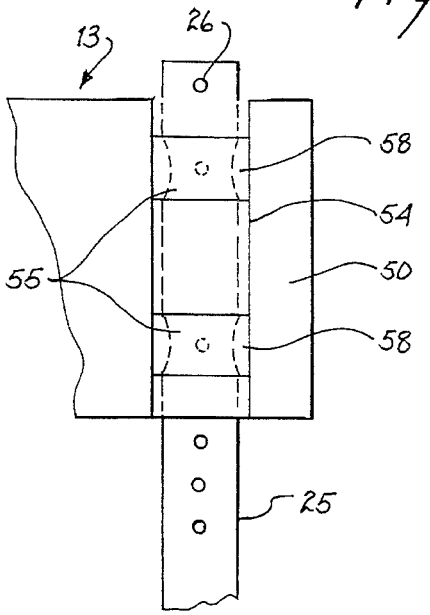
FIG. 3A is a posterior detail view showing how the shock absorbing mechanism is attached to the main frame.
Figure 7A:
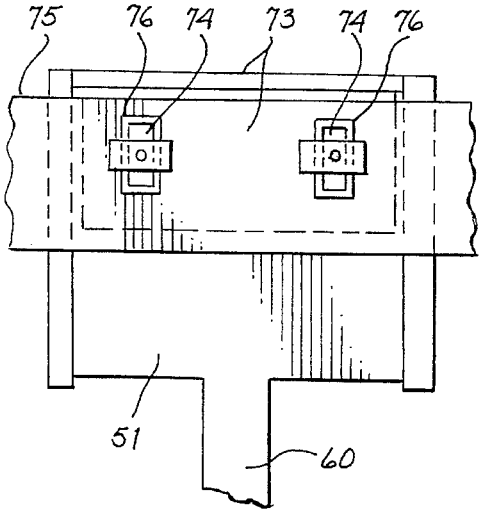
FIG. 7A is an elevation view of the coupling of the pack attachment mechanism with a pack carrier coupling device.
Figure 6:
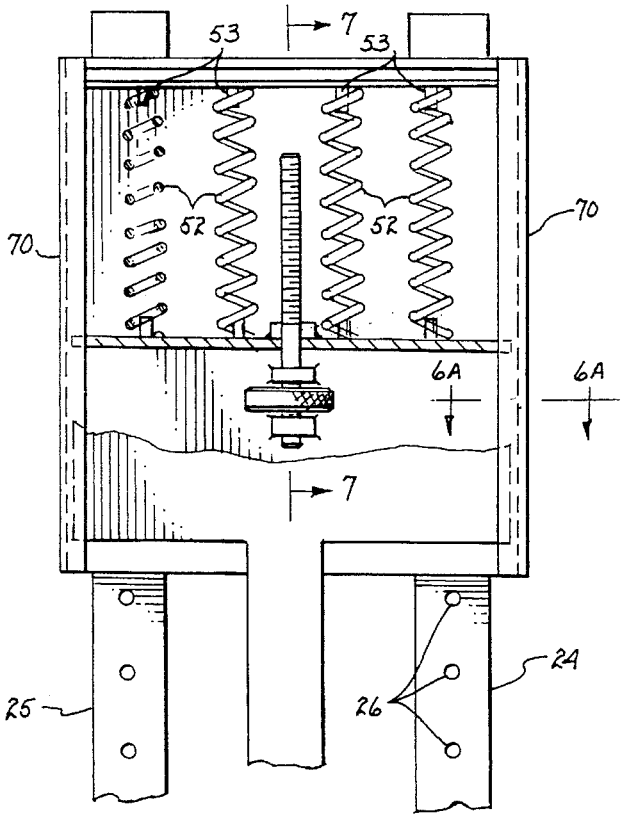
FIG. 6 is an anterior cutaway view of the shock absorbing mechanism showing the compression springs and the spring adjusting screw.
Figure 7:
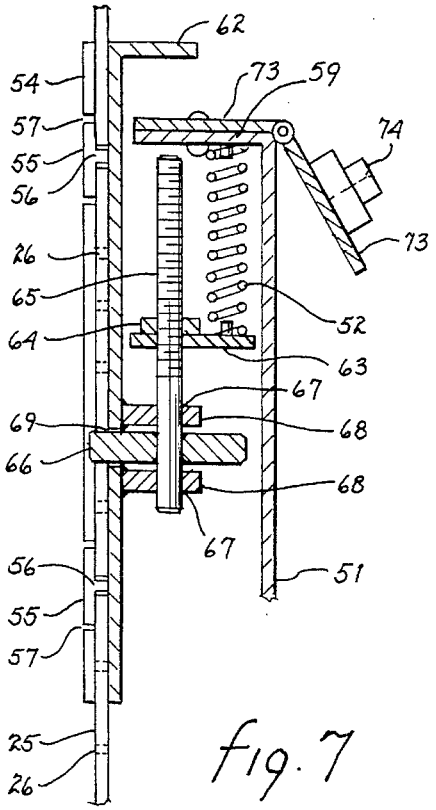
FIG. 7 is an enlarged lateral view along line 7—7 of FIG. 6 showing the springs compressed.
Figure 6A:
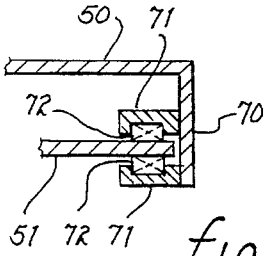
FIG. 6A is a top plan view along line 6A—6A of FIG. 6 showing the sides of the shock absorbing mechanism.

The shock absorbing and pack attachment component 13 (FIGS. 6,7) is a rectangular unit which attaches to the top of the main frame 12 at helices 24 & 25 and vertical stabilizer 23. It has anterior 50 and posterior 51 sides which are parallel and move opposite each other as the shock absorbing mechanism 52 (springs, air or oil shocks) compresses or expands. On the anterior surface of 50 (against wearer's back) are molded two vertical channels 54, one on each side, in which the top ends of helices 24 & 25 pass through. Clips 55 each with a perpendicular circular protuberance 56 snaps snugly into congruous openings 57. The protuberance 56 fits snugly into holes 26 of helices 24 & 25. On the lateral edges of clips 55 are bevelled semi-circular indentations 58 with which to grasp and detach clips (FIGS. 3,3A,7). The posterior side 51 is a flat rectangular piece with an anterior right angle projection 59 at the top, and a narrower descending projection 60 at the bottom (FIG. 1,3,6). At the bottom end of 60 is affixed an encircling bracket 61 through which passes the vertical stabilizer 23 of the main frame 12 (FIGS. 1,3). The top 62 and bottom 63 of the shock absorbing mechanism are parallel and at right angles to the anterior side 50. The bottom 63 is movable up and down by its attachment to nut 64 which is connected to screw 65. Adjusting wheel 66 is connected to screw 65 and as it is rotated the bottom 63 will move up or down. Screw 65 is held in place by passing through openings 67 in brackets 68. Part of adjusting wheel 66 extends through an opening 69 in the anterior side of 50. Affixed to the superior surface of 63 and the inferior surface of 59 are short protuberances 53 used to hold in place springs 52 (FIG 6). The lateral sides 70 of the shock absorbing mechanism are parallel and both are fixed at right angles to the anterior side 50 and at right angles to the top 62 and bottom 63. Affixed to lateral sides 70 at right angles on the inside are brackets 71 which hold bearings 72 between which moves the posterior side 51 as shown in FIG. 6A.

The pack attachment mechanism is a hinged device 73 with the immovable side attached to the superior surface of 59 and the movable side resting against the posterior surface of 51 (FIGS. 3,7). Centered near the lateral edges of the movable side of the pack attachment mechanism 73 are located the coupling devices 74 for the attachment of a multitude of packs. FIG. 7A shows one way for the carrier coupling device 75 of attachable packs to fit onto the pack attachment mechanism 73. On each side of a rectangular carrier coupling device 75 are located rectangular appertures 76 that will receive the pack coupling devices 74 (FIG. 7A). The number and form of the coupling devices connecting the pack to the pack carrier can vary and is not critical to the design and function of the pack attachment mechanism or the rest of the present invention.

When a pack is attached to the shock absorbing and pack attachment mechanism the weight of the burden will be resting on the posterior movable side 51. As the weight pushes side 51 downward, side 59 compresses the shock absorbing mechanism and the weight is transferred to the anterior side 50 and to the main frame helices 24 & 25. This weight then is further absorbed by the helices and transferred to the base 19 of the main frame 12 and vertical stabilizer 23 and directed inward toward the lower lumbar spine and anterior to the sacral base, which is where the body's center of gravity lies and then downward into the legs. The sock absorbing mechanism is adjustable by means of the wheel 66 to shorten or elongate the compression springs 52 according to the weight of the burden carried to allow a little up and down movement of side 51 and the pack attachment mechanism 73. Also, the pack attachment mechanism 73 is hinged to allow the bottom of the pack to be separated from the carrier mechanism so that the carrier and pack can stand alone when not being worn. In addition, the descending arm 60 from side 51 acts as a third leg with helices 24 & 25 to prevent any horizontal rotation and further stabilizes the shock absorbing and pack attachment mechanism and the pack load.

Figure 9:
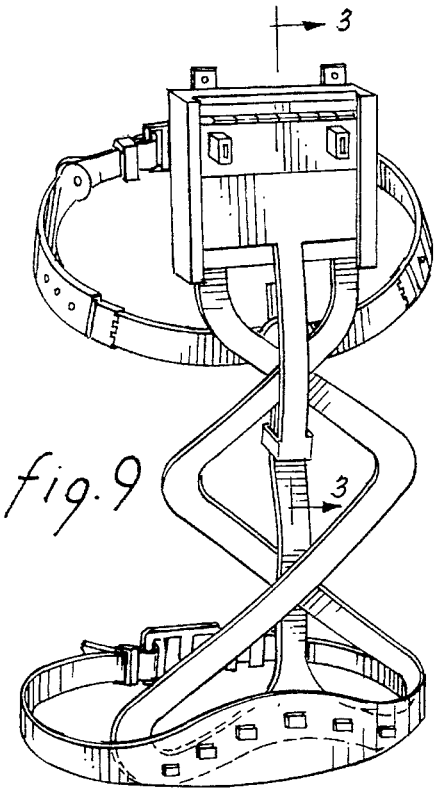
FIG. 9 is a posterior view of a double phase double helix main frame embodiment of the Helixical Backpack Carrier.
Figure 10:
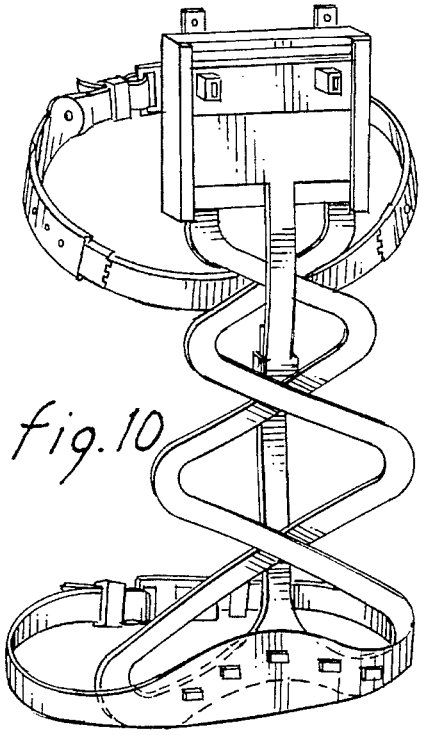
FIG. 10 is a posterior view of a triple phase double helix main frame embodiment of the Helixical Backpack Carrier.

The above detailed description of a preferred embodiment relates to a double helix with a single frequency and amplitude. This same description relates to alternative embodiments having double helices with multiple frequencies and amplitudes as shown in FIGS. 9 & 10, as well as with single and multiple helixical frames of the same nature.

There has thus been shown that the objects set forth above, among those made apparent from the proceeding description, are efficiently attained.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A backpack carrier mechanism which shifts a center of gravity of a load coupled to said backpack carrier mechanism to a location in proximity of a center of gravity of a wearer of said backpack carrier mechanism comprising, in combination:

frame means for supporting said load and for shifting said center of gravity of said load to said location in proximity of said center of gravity of said wearer, said frame means comprising:

base means for transferring weight of said load to said proximity of said center of gravity of said wearer;

support means integrally coupled to each end of said base means for extending and contracting in accordance with movement of said wearer to provide a shock absorption mechanism for said load;

vertical stabilizer means integrally coupled to a middle portion of said base means for transferring weight of said load to said proximity of said center of gravity of said wearer; and shock absorbing means coupled to said support means and said vertical stabilizer means for transferring said weight of said load to said proximity of said center of gravity of said wearer, said shock absorbing means expanding and contracting in relation to said weight of said load and to movement of said wearer;

load attachment means coupled to said shock absorbing means for coupling said load to said frame means;

pelvis belt means coupled to said base means for holding said base means over a sacrum region of said wearer and partially encircling a pelvis region of said wearer so said weight of said load will be transferred towards the inside of said pelvis region to closely approximate said center of gravity of said wearer; and upper body belt means coupled to said vertical stabilizer means for holding a top portion of said frame means against an upper torso region of said wearer.

2. A backpack carrier mechanism in accordance with claim 1 wherein said base means declines laterally from a middle portion of said base means and having an anterior inclination corresponding to a posterior aspect of said sacrum region of said wearer.

3. A backpack carrier mechanism in accordance with claim wherein each of said support means rises vertically, curves inward, crosses to form a least on helix, and rises vertically so each of said support means is parallel to one another.

4. A backpack carrier mechanism in accordance with claim 1 wherein said vertical stabilizer means comprises undulating curves corresponding to thoracolumbar spinal curves of said wearer.

5. A backpack carrier mechanism in accordance with claim 1 wherein said backpack carrier mechanism further comprises adjusting means coupled to said shock absorbing means to lengthen or shorten said shock absorbing means in accordance with said weight of said load.

6. A backpack carrier mechanism in accordance with claim 1 wherein said upper body belt means encircles said wearer under both arms from a mid thorax region in a back region of said wearer to just below a sternum region in a front region of said wearer, said upper body encircling means being able to move in an upward and downward manner to allow for expansion and contraction of said sternum region of said wearer so said wearer has unrestricted diaphragmatic movement when breathing.

7. A backpack carrier mechanism in accordance with claim 1 wherein said pelvis belt means comprises:

a body coupled to said base means, said body declines laterally from a middle portion of said body to each end of said body;

an adjustable belt coupled to each end of said body; and buckle means coupled to said adjustable belt for securely holding said base means of said backpack carrier mechanism to said pelvis region of said wearer.

8. A backpack carrier mechanism in accordance with claim 1 wherein said upper body belt means comprises:

first leg rotatably coupled to said vertical stabilizer means, said first leg being curved to encircle a portion of said upper torso region of said wearer;

second leg rotatably coupled to said vertical stabilizer means, said first leg being curved to encircle a portion of said upper torso region of said wearer;

first adjustable belt coupled to said first leg;

second adjustable belt coupled to said second leg; and buckle means coupled to said first adjustable belt and to said second adjustable belt for securely holding said top portion of said frame means against said upper torso region of said wearer.

9. A backpack carrier mechanism in accordance with claim 8 wherein said upper body belt means further comprises:

a first connector coupled to said first leg;

a second connectors being coupled to said second leg;

a first stabilizing strap having a first and second end, said first end of said first stabilizing strap being coupled to said load and said second end of said first stabilizing strap being coupled to said first connector; and a second stabilizing strap having a first and second end, said first end of said second stabilizing strap being coupled to said load and said second end of said second stabilizing strap being coupled to said second connector.

10. A backpack carrier mechanism in accordance with claim 1 wherein said load attachment means comprises:

a hinged device having a first end coupled to a top portion of said shock absorbing means and a second end resting against a front portion of said shock absorbing means; and connector means coupled to said second end of said hinged device for coupling said load to said backpack mechanism.

11. A backpack carrier mechanism in accordance with claim 1 wherein at least one of said base means, a lower portion of said vertical stabilizer means, said pelvis belt means and said upper body belt means are padded for providing greater comfort to said wearer.

* * * * *